US007610755B2

(12) United States Patent
Imanishi et al.

(10) Patent No.: US 7,610,755 B2
(45) Date of Patent: Nov. 3, 2009

(54) HYDRAULIC CONTROL APPARATUS OF WORKING MACHINE

(75) Inventors: Etsujiro Imanishi, Kobe (JP); Naoki Sugano, Kobe (JP); Takao Nanjo, Kobe (JP); Hidekazu Oka, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 217 days.

(21) Appl. No.: 11/680,966

(22) Filed: Mar. 1, 2007

(65) Prior Publication Data

US 2007/0204606 A1 Sep. 6, 2007

(30) Foreign Application Priority Data

Mar. 2, 2006 (JP) ..... 2006-056744

(51) Int. Cl.
*F16D 31/02* (2006.01)

(52) U.S. Cl. ..... 60/452

(58) Field of Classification Search ..... 60/452
See application file for complete search history.

(56) References Cited

U.S. PATENT DOCUMENTS

2005/0204735 A1 9/2005 Sugano ..... 60/452

FOREIGN PATENT DOCUMENTS

| | | |
|---|---|---|
| JP | 3-55323 | 3/1991 |
| JP | 10-246204 | 9/1998 |
| JP | 2002-38536 | 2/2002 |
| JP | 2004-225867 | 8/2004 |
| JP | 2005-265002 | 9/2005 |

*Primary Examiner*—F. Daniel Lopez
(74) *Attorney, Agent, or Firm*—Oblon, Spivak, McClelland, Maier & Neustadt, L.L.P.

(57) ABSTRACT

With respect to a method of controlling a pump flow rate of a hydraulic pump, a method having a small flow rate command value is selected between a pressure feedback control for controlling the pump flow rate based on a set pressure (a cutoff pressure) and a pump pressure, and, an ordinary control for controlling the pump flow rate based on operation information, and in a case that the pressure feedback control is selected, a flow rate increasing control for increasing the flow rate command value after the case with the passage of time is performed.

6 Claims, 9 Drawing Sheets

HYDRAULIC CONTROL APPARATUS OF WORKING MACHINE

BACKGROUND OF THE INVENTION

1. Field of the Invention

The present invention relates to a hydraulic control apparatus in a working machine such as a hydraulic excavator.

2. Description of the Related Art

Cutoff control in a hydraulic control apparatus for cutoff control of pump flow rate is performed, in a hydraulic circuit provided with a relief valve for determining a maximum pressure of the circuit, for the purpose of reducing energy loss by reducing a relief flow rate, that is, a passing flow rate of the relief valve.

With respect to techniques of performing the cutoff control, the following techniques have been known.

(1) A technique disclosed in Japanese Unexamined Patent Application Publication No. 10-246204. In a negative control, a throttle is provided in a downstream side of a relief valve. In the case that a pressure of an upstream side of the throttle increases, a pump flow rate is decreased.

(2) A technique disclosed in Japanese Unexamined Patent Application Publication No. 2002-038536. A temperature of a relief valve is detected and in the case that the relief valve temperature increases, a pump flow rate is decreased.

(3) A technique disclosed in Japanese Unexamined Patent Application Publication No. 2005-265002. A pressure feedback control is performed so that a pump pressure is to be a set value or below the set value.

However, according to Japanese Unexamined Patent Application Publication No. 10-246204, the throttle is provided in the downstream side of the relief valve. Then, a pressure loss due to the throttle occurs, and the desired effect in energy efficiency improvement in the entire system is not enough.

According to Japanese Unexamined Patent Application Publication No. 2002-038536, due to heat capacity of the relief valve, a time lag is generated between a generation of the relief flow rate and a temperature increase of the relief valve, the execution of the cutoff control is delayed. Accordingly, the reduction effect of the relief loss is not enough. Further, after the relief flow rate becomes zero, the remaining heat is still detected and the cutoff control is continued. Accordingly, the actuator flow rate comes short, and the driving force is reduced.

On the other hand, according to Japanese Unexamined Patent Application Publication No. 2005-265002, the pressure feedback control is performed so that the pump pressure is to be the set value (cutoff pressure) or below the set value. Then, basically, the relief flow rate can be reduced and this is effective in the energy efficiency improvement.

More particularly, in this case, between the pressure feedback control for cutoff and an ordinary control (a positive control, a negative control, a load sensing control, or the like) for controlling the pump flow rate based on operation information, a control having a smaller flow rate command value is selected. Then, the pressure feedback control is selected, and the cutoff operation is carried out.

However, the pressure feedback control aims for a smaller pressure than the set pressure of the relief valve. Accordingly, as long as the pressure feedback control is selected, the pump pressure is not increased to the maximum pressure, and the driving force comes short and result in, for example, decrease in hill-climbing ability on a sloping road.

In Japanese Unexamined Patent Application Publication No. 2005-265002, as a countermeasure for the hill-climbing ability, a tilt of a vehicle body is detected, and on a sloping road, the cutoff control, that is, the pressure feedback control, is switched to "off".

However, in such a structure, detection means for detecting the tilt of the vehicle body and the wiring equipment for the detection means have to be newly added to the existing circuit. Accordingly, the instillation cost is increased and the application of the detection means and the wiring equipment on the existing machine is difficult.

Further, the shortage of driving force can occur not only in the hill-climbing but in various operations, however, any countermeasure to this problem has not been taken.

For example, in rotation, since a rotation motor is not immediately accelerated due to the effect of inertia of the rotating body, an inflow flow rate is greater than an outflow flow rate. Thus, the circuit pressure increases, and by the pressure feedback control performed in response to the pressure increase, the pump flow rate is controlled.

In the case that such a state is continued, the relief flow rate is reduced. However, the rotation pressure is not increased, and the rotating body can rotate in only a very slow speed or can stop without rotation. This can occur in rotation on a flat road, and the problem becomes significant in an increasing rotation at the time of rotating to the upper side on a sloping road.

SUMMARY OF THE INVENTION

Accordingly, it is an object of the present invention to provide a hydraulic control apparatus of working machine capable of reducing all problems in driving force shortage due to the cutoff control while improving the energy efficiency with the cutoff control, and further, additional installation of new equipment is not necessary.

First, the hydraulic control apparatus of working machine according to the present invention has the following basic structure.

That is, the apparatus according to the present invention includes a hydraulic circuit, and the circuit includes a hydraulic pump, a hydraulic actuator driven by the hydraulic pump as a driving source, a control valve for controlling supply and discharge of oil with respect to the hydraulic actuator, a relief valve for setting a maximum pressure of the hydraulic circuit, and control means.

The control means is adapted to, (i) with respect to a method of controlling a pump flow rate of the hydraulic pump, select a method having a small flow rate command value between a pressure feedback control for controlling the pump flow rate based on a set pressure as a cutoff pressure and a pump pressure, and, an ordinary control for controlling the pump flow rate based on operation information, and (ii) in a case that the pressure feedback control is selected, perform a flow rate increasing control for increasing the flow rate command value after the case with the passage of time.

According to the present invention, on the premise that between the pressure feedback control for the cutoff that the pump flow rate is commanded based on the pump pressure and the set pressure, and, the ordinary control that the pump flow rate is commanded based on the operation information, the control method which has the small flow rate command value is selected and executed, in the case that the pressure feedback control is selected, the flow rate increasing control that the flow rate command value is increased starting at the selection time with the passage of time, is performed (according to an aspect of the present invention, a control gain is reduced and according to another aspect of the present invention, the set pressure is increased). Accordingly, first, the relief flow rate is controlled, to improve the energy efficiency, and finally, the driving force (the hill-climbing ability on a sloping road or the rotation force) can be increased by increasing the pressure. With respect to the flow rate increasing control, as will be described below, it is preferable to perform a control to reduce the control gain or increase the set pressure.

That is, the improvement of the energy efficiency and the driving force can be balanced, while the original purpose of the cutoff can be achieved, the shortage of the driving force due to the cutoff control can be reduced.

Moreover, the above control can be carried out by a control means program, and the sensor for detecting the tilt of the vehicle body and the wiring equipment for the sensor discussed in Japanese Unexamined Patent Application Publication No. 2005-265002 are not necessary to be newly added to the existing circuit. Accordingly, the instillation cost is not expensive and can be readily applied on the existing machine.

With respect to the above ordinary control, a positive control, a negative control, a PQ control, a load sensing control, or the like, can be employed.

In the case that operation means is operated again after the operation means is returned to neutral in a state that the flow rate increasing control is not released (the flow rate command value is large), a flow rate command value according to the ordinary control (for example, the positive control) is selected. Then, the relief flow rate reducing function is not performed.

With respect to a preferred structure of the above-described flow rate increasing control, in the above-described structure, the control means, in the case that the pressure feedback control is selected, as the flow rate increasing control, is adapted to reduce the control gain with the passage of time.

In another preferred structure of the flow rate increasing control, in any one of the above-described structures, the control means, in the case that the pressure feedback control is selected, as the flow rate increasing control, is adapted to increase the set pressure with the passage of time.

Further, it is preferable that the control means, after the pressure feedback control is selected, in the case that the flow rate command value of the ordinary control is selected as the small value, is adapted to reset the flow rate increasing control.

In such a case, at the time the possibility of the selection of the flow rate command value according to the pressure feedback control is eliminated (at the time the ordinary control is selected), the flow rate increasing control is reset. Thus, at the time the operation is performed again, the pressure feedback control of small flow rate command value is selected. Accordingly, the relief flow rate reducing effect can be ensured.

Further, it is preferable that the control means is adapted to select on or off of the flow rate increasing control in the pressure feedback control.

In such a case, in the pressure feedback controls, it is possible to select the control with the flow rate increasing control or the control without the flow rate increasing control. Accordingly, it is possible to select the relief flow rate reduction or the balanced control.

Further, it is preferable that the control means further includes mode switching means, and with the mode switching means, a control mode is adapted to be selected among an energy-saving mode for performing a selection of a small value of a flow rate command value between the pressure feedback control not having the flow rate increasing control and the ordinary control, an energy-saving high mode for performing the selection of the small value of the flow rate command value between the pressure feedback control having the flow rate increasing control and the ordinary control, and, a high-power mode for turning off the pressure feedback control and performing only the ordinary control.

In such a case, the control mode can be selected among (a) the energy-saving mode for performing a selection of a small value of a flow rate command value between the pressure feedback control not having the flow rate increasing control and the ordinary control, (b) the energy-saving high mode for performing the selection of the small value of the flow rate command value between the pressure feedback control having the flow rate increasing control and the ordinary control, and (c) the high-power mode for turning off the pressure feedback control and performing only the ordinary control. Accordingly, it is possible to carry out a desired control.

DESCRIPTION OF THE PREFERRED EMBODIMENTS

Figure 1:
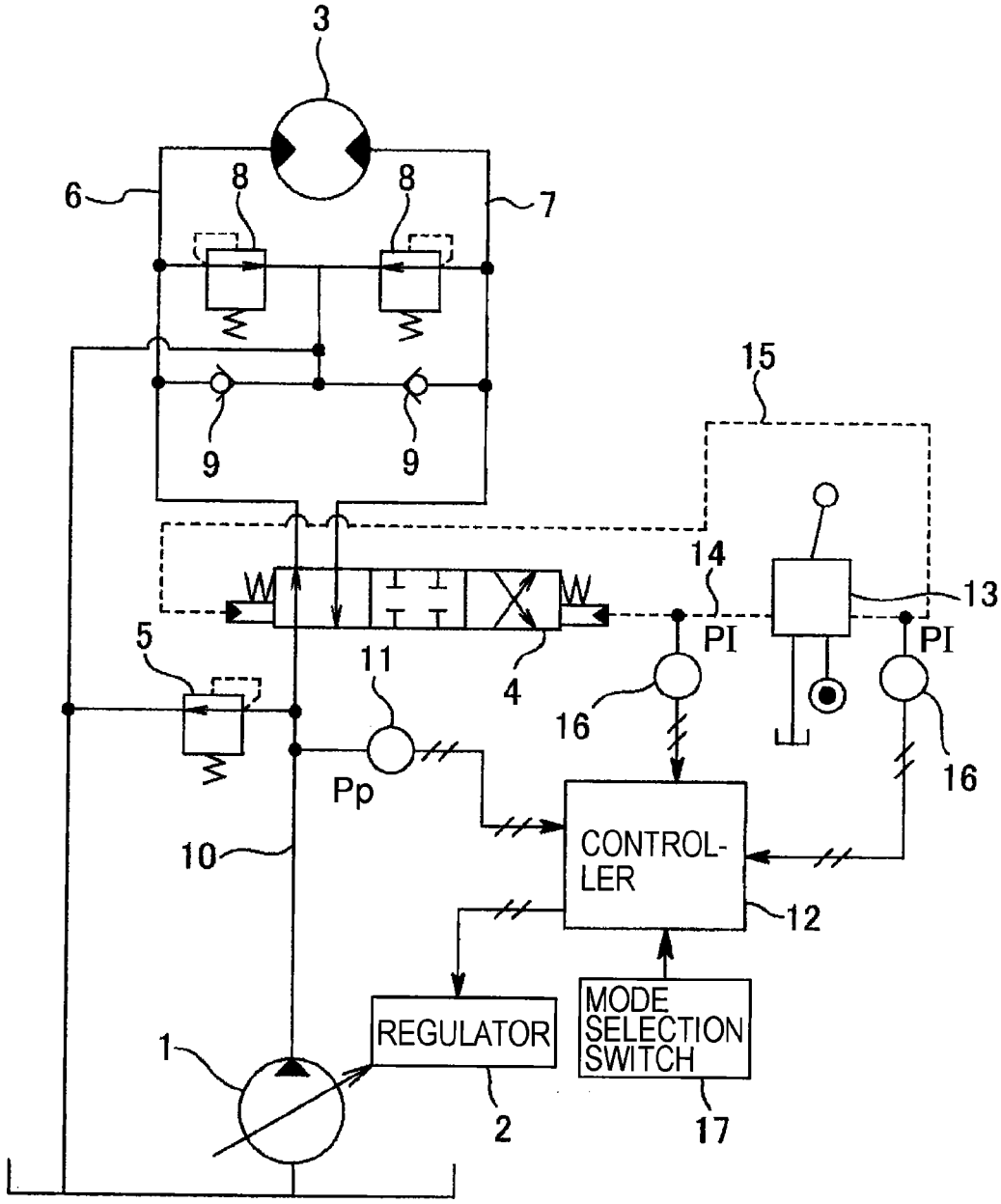
FIG. 1 PRIOR ART
FIG. 1 is a schematic diagram of a hydraulic circuit of a working machine to which an embodiment of the present invention may be adapted.
Figure 2:
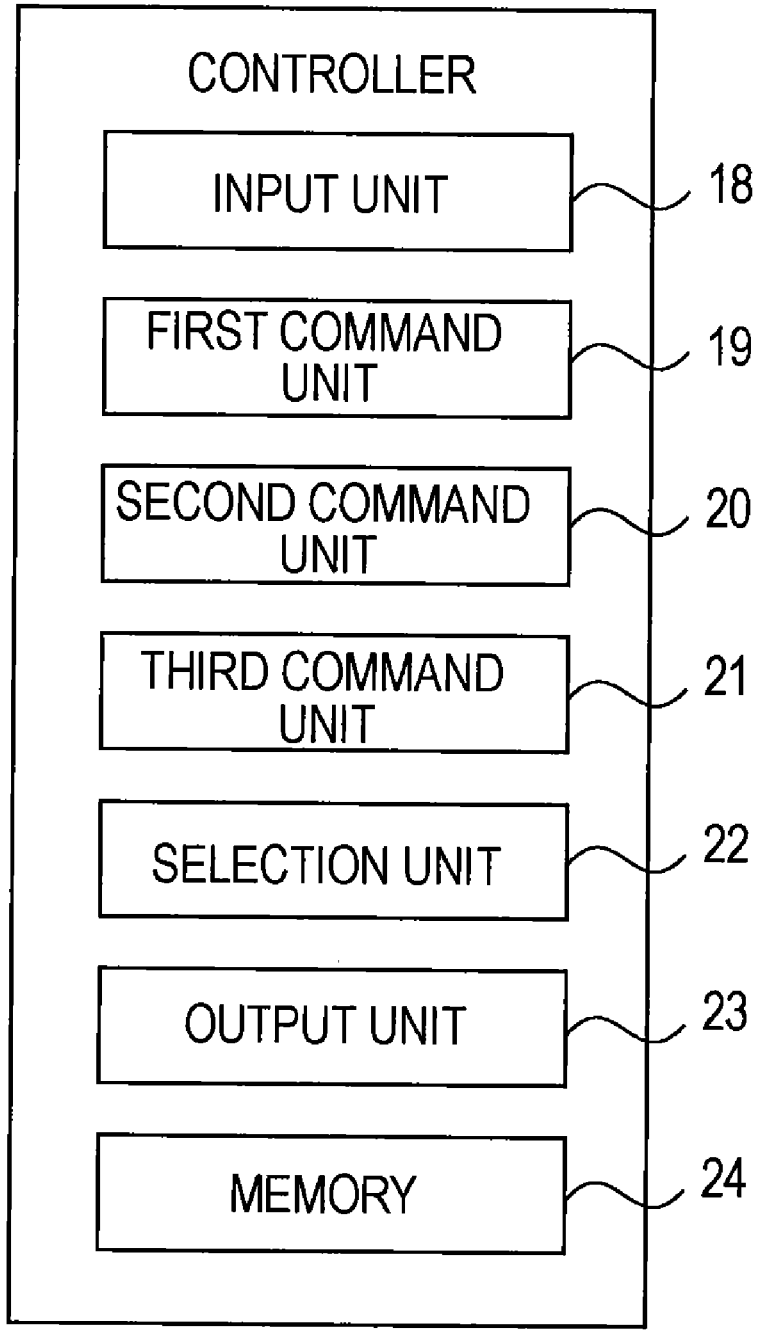
FIG. 2 PRIOR ART
FIG. 2 is a view illustrating a structure of a controller.

FIG. 1 is a schematic diagram of a hydraulic circuit of working machine, for example, a hydraulic excavator, according to the embodiment of the present invention, and FIG. 2 is a view illustrating an internal structure of a controller as control means, respectively.

In FIG. 1, a variable displacement type hydraulic pump 1 is a hydraulic source, a regulator 2 controls a discharge amount (pump flow rate) of the pump 1, a hydraulic motor 3 is an example of hydraulic actuators, a hydraulic pilot type control valve 4 controls supply and discharge of oil with respect to the hydraulic motor 3, and a relief valve 5 sets a maximum pressure of the circuit.

Between both conduits 6 and 7 which connect the control valve 4 and the hydraulic motor 3, port relief valves 8 and make up check valves 9 are provided. T denotes a tank.

On a pump line 10 in which pump oil is discharged, a pump pressure sensor 11 is provided. A pump pressure (upstream side pressure of the relief valve 5) is detected by the pump pressure sensor 11, and the detected pressure is sent to a controller 12.

On both sides pilot lines 14 and 15 of a remote control valve 13 for operating the control valve 4, pilot pressure sensors 16 are provided respectively. Signals (pilot pressure signals) from the sensors 16 are also sent to the controller 12.

Further, a mode selection switch 17 is connected to the controller 12, and control modes are switched by the switch 17. With respect to this point, detailed description will be made below.

As shown in FIG. 2, the controller 12 includes an input unit 18 for taking in a pump pressure signal or a pilot pressure signal, and first, second, and third command units 19 to 21 for outputting a pump flow rate command value (hereinafter, simply referred to as a flow rate command value) according to each control method of the pressure feedback, positive, and PQ based on the taken pump pressure. Further, the controller 12 includes a selection unit 22 for comparing each flow rate command value and selecting (selecting a small value) a control method which has a smallest flow rate command value, an output unit 23 for outputting the flow rate command value according to the selected control method to the regulator 2, and a memory 24 for storing various programs and data.

The contents of the each control method are described.

Figure 3:
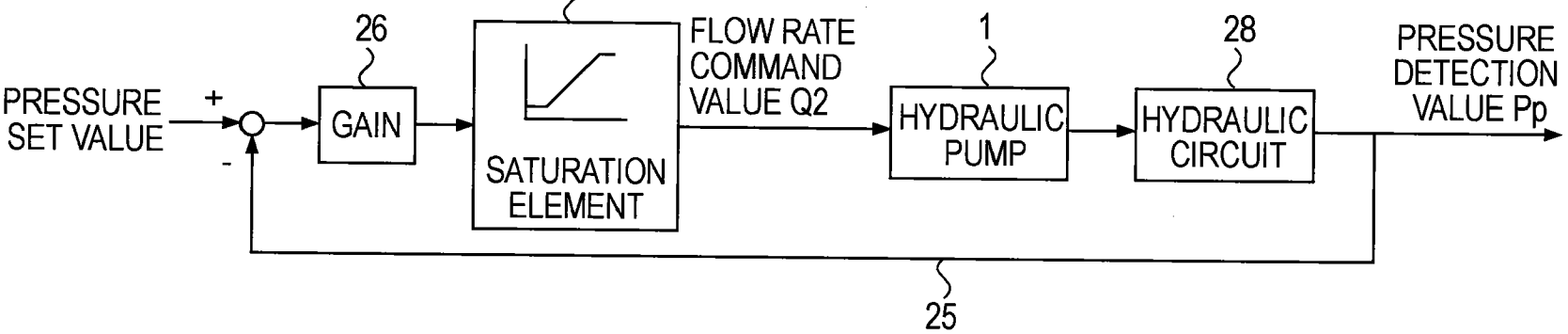
FIG. 3 PRIOR ART
FIG. 3 is a view for explaining a pressure feedback control.

In the pressure feedback control, as shown in FIG. 3, a feedback circuit is used which includes a feedback loop 25, a control gain element 26, a saturation element 27, the hydraulic pump 1, and a hydraulic circuit 28.

The first command unit 19 of the controller 12 calculates a deviation by comparing a detected pump pressure Pp with a set pressure (cutoff pressure) through the feedback loop 25. Then, the first command unit 19 adds a control gain to the deviation in the control gain element 26, and determines a flow rate command value Q2 with respect to the hydraulic pump 1 using the saturation element 27.

Figure 4:
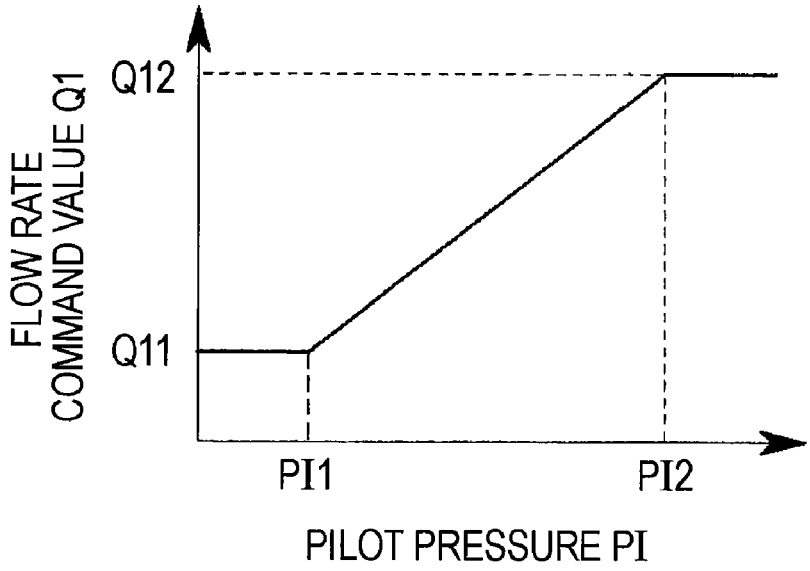
FIG. 4 PRIOR ART
FIG. 4 is a view illustrating a relation between a pilot pressure and a flow rate command value in a positive control.

On the other hand, in the positive control which is one of ordinary controls, a flow rate command value Q1 is calculated based on a relation (positive control map) between a pilot pressure PI and the flow rate command value Q1 shown in FIG. 4. In the example shown in FIG. 4, within the range from the pilot pressure PI1 to the pilot pressure PI2, proportional pump flow rates Q11 to Q12 are calculated.

Figure 5:
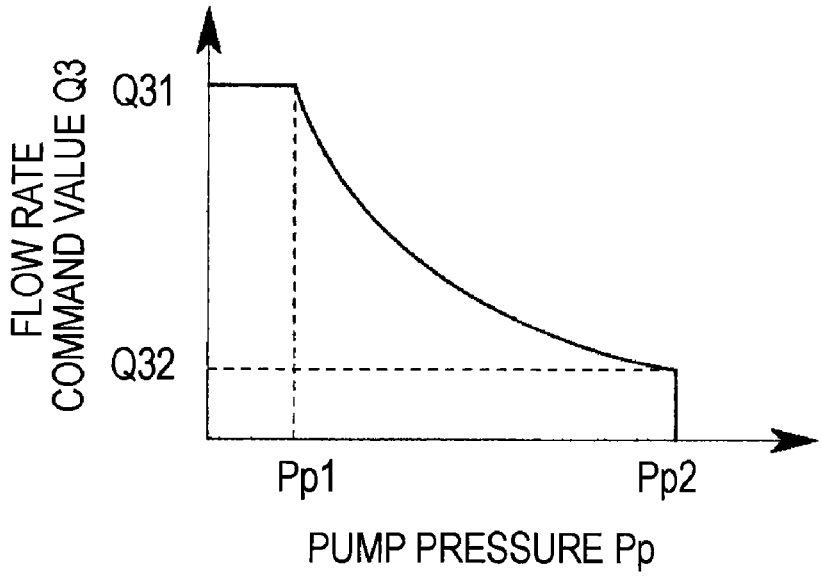
FIG. 5 PRIOR ART
FIG. 5 is a view illustrating a relation between a pump pressure and a flow rate command value in a PQ control.

In another ordinary control, that is, the PQ control, a flow rate command value Q3 with respect to the pump pressure Pp is calculated using a relation (PQ control map) between the pump pressure Pp and the flow rate command value Q3 shown in FIG. 5. In the example shown in FIG. 5, within the range from the pump pressure Pp1 to the pump pressure Pp2, inversely proportional flow rate command values Q31 to Q32 are calculated.

Figure 6:
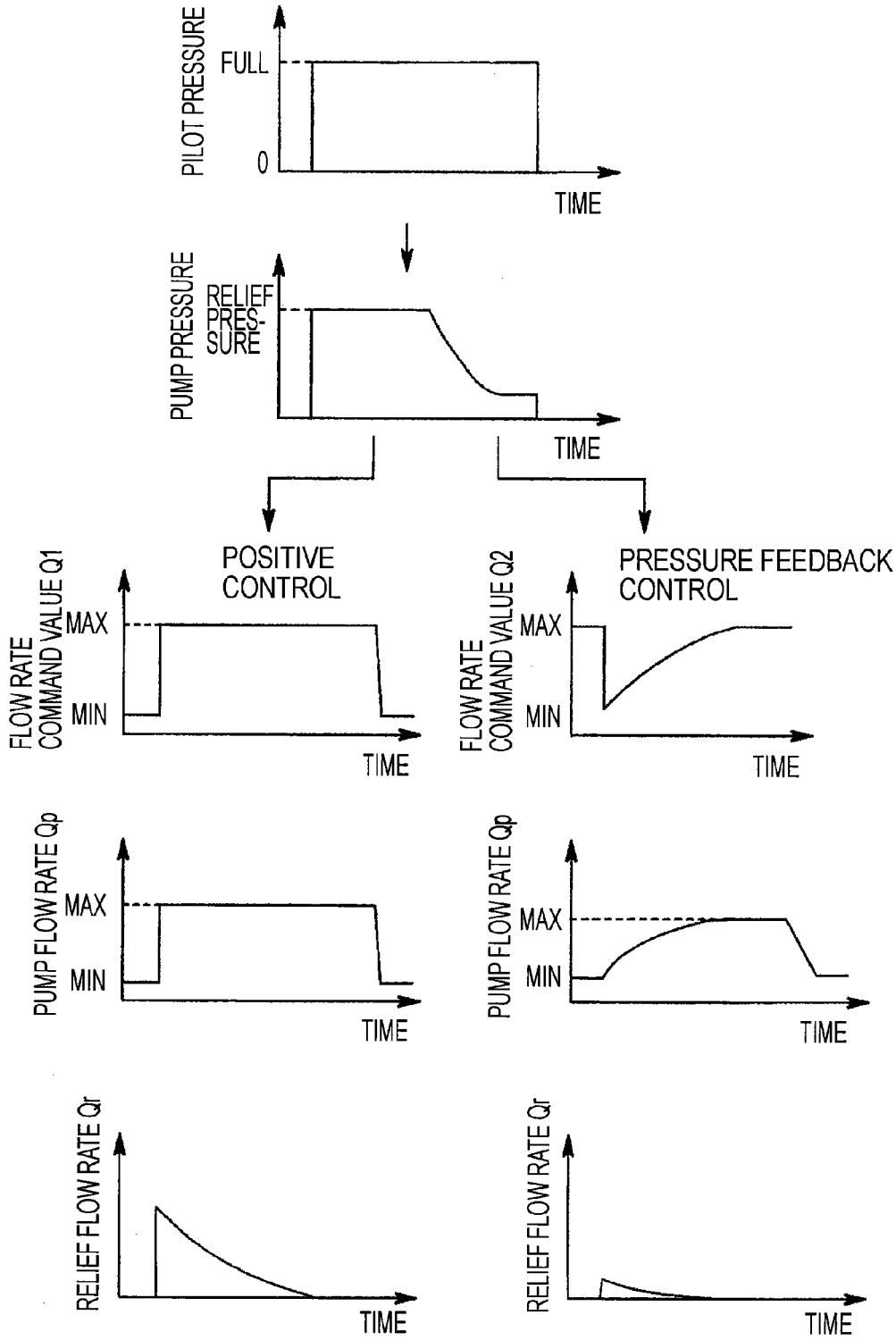
FIG. 6 PRIOR ART
FIG. 6 is a view illustrating responses of a pressure and a flow rate according to both of the positive control and the pressure feedback control.

In order to clarify differences between the pressure feedback control and the ordinary controls, for example, with respect to a relation between pressure and response of rotation, a description is made with reference to FIG. 6. In this description, the pressure feedback control is compared to the positive control.

As shown at the top in FIG. 6, in the case that the pilot pressure is increased stepwise to the full, as shown at the third left from the top in FIG. 6, in the positive control, the flow rate command value Q1 becomes the maximum flow rate stepwise, and the pump flow rate Qp also become the maximum value.

However, the rotation motor is not immediately accelerated due to the effect of inertia of the rotating body, and the inflow flow rate is greater than the outflow flow rate. As a result, the pump pressure increases to the relief pressure, and as shown at the left bottom in FIG. 6, the relief flow rate Qr increases.

On the other hand, in the pressure feedback control, with the increase of the above pump pressure, as shown at the third right from the top in FIG. 6, the flow rate command value Q2 decreases to the minimum value. As a result, as shown at the bottom right in FIG. 6, the relief flow rate Qr also greatly decreases as compared to the case of the positive control. That is, the relief loss can be kept to the minimum, and it contributes energy saving.

With respect to the PQ control, the pump flow rate is cut in the case that a load is large, for example, in excavation operation, and in the case of ordinary rotation in the air, the flow rate command value becomes the maximum flow rate.

In view of the above, in this embodiment, among the positive, pressure feedback, and PQ control methods, a control method which has a minimum flow rate command values Q1, Q2, or Q3 is selected and executed. Accordingly, in the case that the pump pressure increases, the pressure feedback control is to be selected.

However, the pressure feedback control aims for a smaller value (cutoff pressure) than the set pressure of the relief valve. Accordingly, as long as the pressure feedback control is selected, the pump pressure is not increased to the maximum pressure quickly enough, and the driving force comes short. As a result, the hill-climbing ability on a sloping road decreases.

Further, in the case that the pump flow rate is controlled by the pressure feedback control and such a state is continued, the relief flow rate is reduced. However, the rotation pressure is not increased, and the rotating body can rotate in only a very slow speed or can stop without rotation.

Accordingly, in this embodiment, while the energy efficiency is improved with the cutoff control, the all problems in driving force shortage due to the cutoff control can be reduced.

Figure 7:
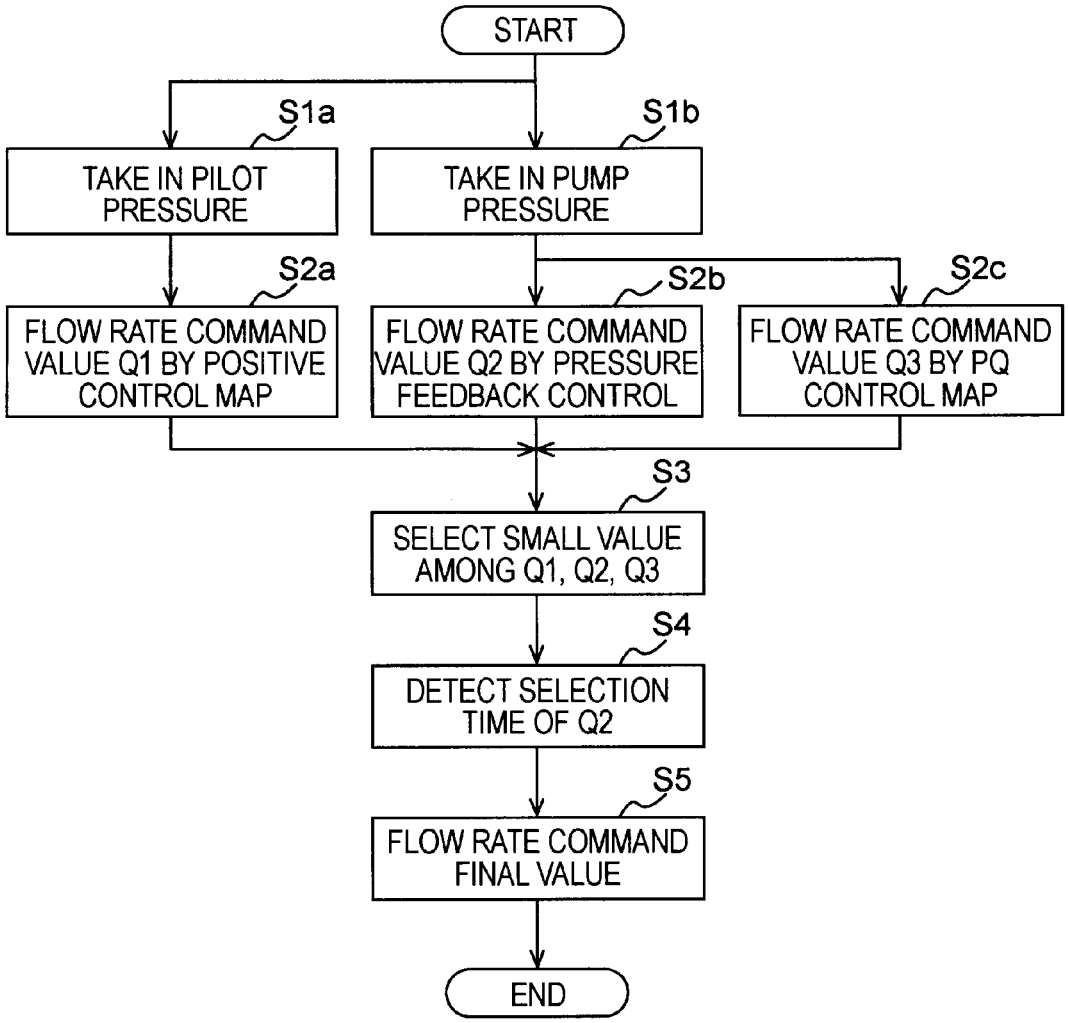
FIG. 7 is a flowchart for explaining an operation according to the embodiment.

FIG. 7 is the flowchart illustrating the operation of the controller 12.

At steps S1*a* and S1*b*, the pilot pressure and the pump pressure are taken in, and then, at steps S2*a*, S2*b*, and S2*c*, the flow rate command values Q1, Q2, and Q3 are calculated in the positive, pressure feedback, and PQ controls respectively.

Then, at step S3, by the selection unit 22 of FIG. 2, among the flow rate command values Q1 to Q3, a minimum value (a control method which has a minimum flow rate command value) is selected and at step S4, the selected time is detected.

At step S5, a final value of the flow rate command value is determined, and a flow rate command signal based on the final value is output from the output unit 23 of FIG. 2 to the regulator 2 of FIG. 1.

At step S3, in the case that the pressure feedback control is selected, a flow rate increasing control for increasing the flow rate command value with the passage of time is performed.

Figure 8:
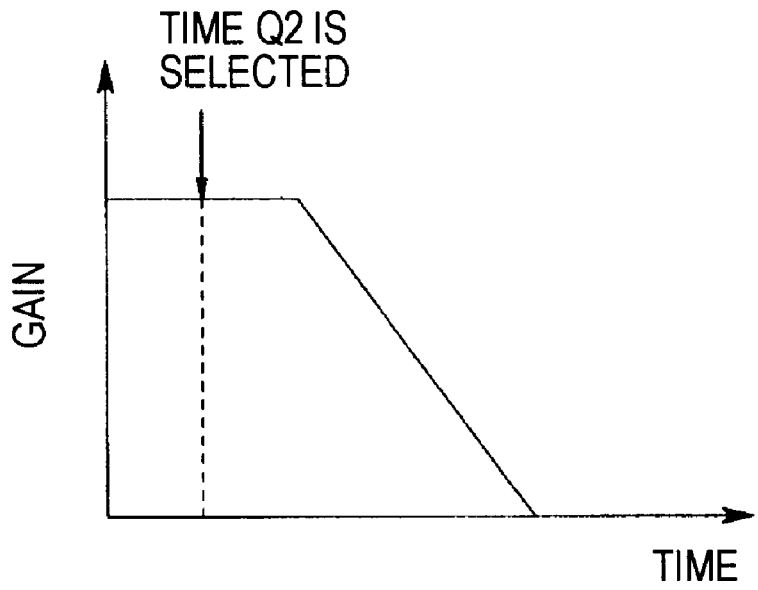
FIG. 8 is a view illustrating a state that a control gain is reduced with the passage of time according to the embodiment.
Figure 9:
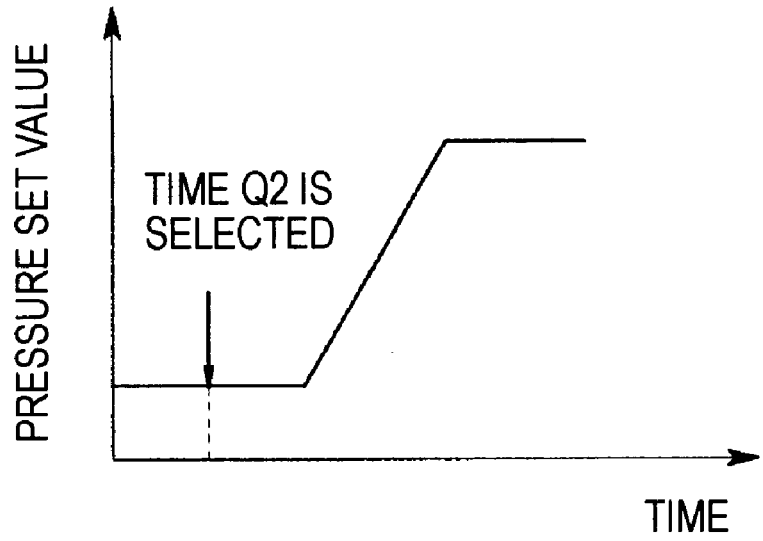
FIG. 9 is a view illustrating a state that a set pressure value is increased with the passage of time according to the embodiment.

The flow rate increasing control is performed, more particularly, in the pressure feedback circuit of FIG. 3, by reducing the gain of the control gain element 26 (see FIG. 8) or by increasing the pressure set value (see FIG. 9) based on a function of time after the case with the passage of time.

Figure 10:
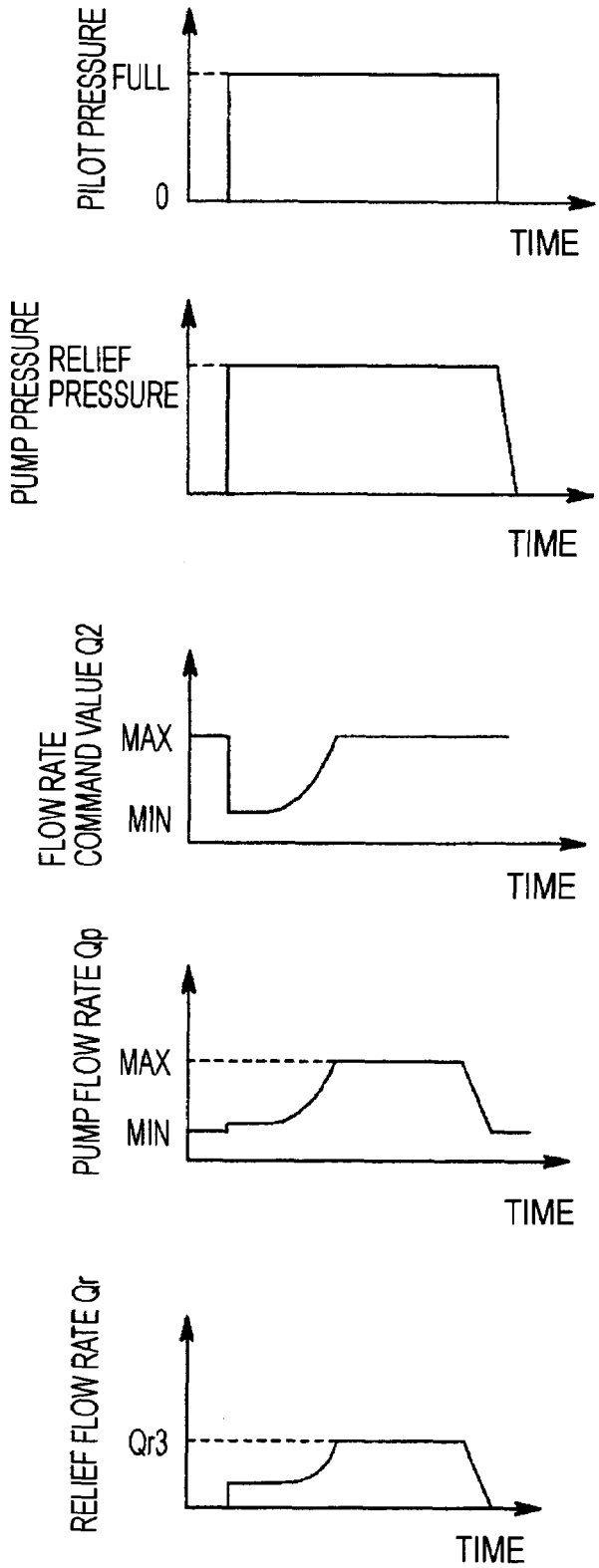
FIG. 10 is a view illustrating responses of pressures and flow rates by a flow rate increasing control according to the embodiment.

By the pressure feedback control with the flow rate increasing control, as shown in FIG. 10, the pump flow rate Qp is more rapidly increased with the passage of time, and the relief flow rate Qr is also increased. Then, after a certain time has passed, with the small value selection operation, another flow rate command value Q1 or Q3 is to be selected, and the maximum value of the relief flow rate Qr becomes Qr3.

Accordingly, by executing the control, while the original energy-saving effect of cutoff is reduced with the passage of time, the pump pressure is increased and the driving force is increased. Thus, the hill-climbing ability on a sloping road and the rotation ability can be increased. Then, for example, at a time of increasing rotation, it can be prevented that the rotation speed is extremely reduced or the rotation stops.

That is, the improvement of the energy efficiency and the securement of the driving force can be balanced, while the original purpose of the cutoff can be achieved, the shortage of the driving force due to the cutoff control (pressure feedback control) can be reduced.

Moreover, the above control can be carried out by a program in the controller 12, and the sensor for detecting the tilt of the vehicle body and the wiring equipment for the sensor discussed in Japanese Unexamined Patent Application Publication No. 2005-265002 are not necessary to be newly added. Accordingly, the instillation cost of the program is not expensive and can be readily applied on the existing machine.

In the flow rate increasing control, the method of increasing the flow rate command value Q2 can be variously selected depending on the character to be obtained or the like. For example, the tilt of increase of the pump flow rate command value Q2 can be changed to a plurality of values of large or small.

In the case that the remote control valve 13 is operated again after the remote control valve 13 is returned to neutral in a state that the flow rate increasing control is not released (the flow rate command value is large), a flow rate command value according to the positive control is selected at the time, and it is not possible to perform the relief flow rate reducing function.

In view of the above, in this embodiment, in the flow of FIG. 7, at the time the possibility of the selection of the flow rate command value Q2 according to the pressure feedback control is eliminated (at the time the positive control is selected), the flow rate increasing control is reset.

Thus, in the case that after the remote control valve 13 is returned to neutral and operated again, the pressure feedback control of small flow rate command value is selected again, and the control shown in FIG. 10 is executed. Accordingly, the relief flow rate reducing effect can be ensured.

Figure 11:
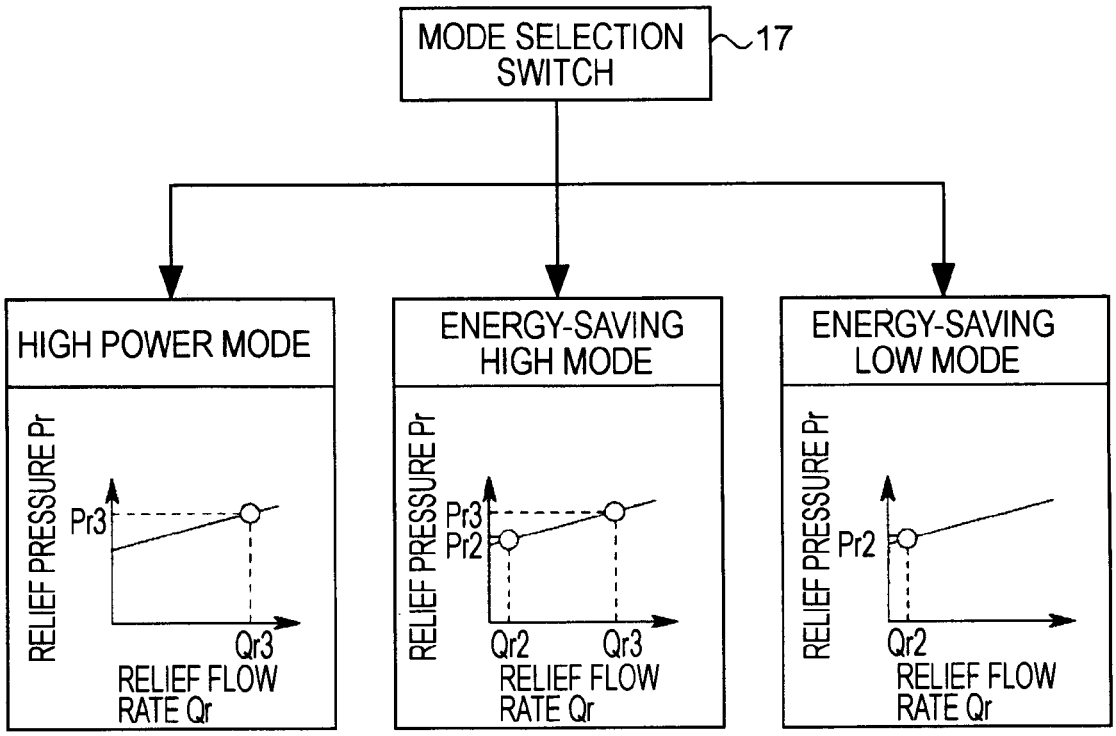
FIG. 11 is a view for explaining a mode switching operation according to the embodiment.

Now, the mode switching function is described with reference to FIG. 11.

The controller 12 of FIG. 1 has three modes, that is, an energy-saving low mode (Low), a energy-saving high mode (High), and a high power mode. With the mode selection switch 17 in FIG. 1, one mode is selected among the three modes.

In the case that the energy-saving low mode is selected, the small value selection from the positive, pressure feedback, and PQ controls is performed.

In the energy-saving low mode, the flow rate increasing control is set not to work, and only the basic pressure feedback control is set to work. Accordingly, in the case that the pressure feedback control is selected, the maximum value of the relief flow rate is controlled to be Qr2, and the energy saving effect can be expected.

On the other hand, in the energy-saving high mode, the flow rate increasing control is set to work. In the case that the pressure feedback control is selected with the small value selection, as shown in FIG. 10, the balanced control with energy saving and driving force is performed.

In the case that the high-power mode is selected, the pressure feedback control is turned off, and the small value selection is performed between the positive control and the PQ control. As a result, the pressure is increased and a control of high acceleration and high hill-climbing ability on a sloping road is carried out.

As described above, in the pressure feedback control, either the control with the flow rate increasing control (the energy-saving high mode) or the control without the flow rate increasing control (the energy-saving low mode) can be selected. That is, with respect to the pressure feedback control, the flow rate increasing control can be turned on or off. Accordingly, it is possible to select the relief flow rate reduction or the balanced control.

Further, with the addition of the high-power mode, the options are widened, and it is possible to select a desired control corresponding to the contents of the operation.

It is to be understood that in the above embodiment, although the positive control and the PQ control are described as the example of the ordinary controls, other control methods, for example, a negative control, a load sensing control, or the like, can be employed and the number of the control is not limited.

Although the invention has been described with reference to the preferred embodiments in the attached figures, it is noted that equivalents may be employed and substitutions made herein without departing from the scope of the invention as recited in the claims.

What is claimed is:

1. A hydraulic control apparatus of a working machine having a hydraulic circuit, the circuit comprising:

a hydraulic pump;

a hydraulic actuator driven by the hydraulic pump as a driving source;

a control valve for controlling supply and discharge of oil with respect to the hydraulic actuator;

a relief valve for setting a maximum pressure of the hydraulic circuit; and a controller having:

selecting means for selecting, as a flow rate command value, a smaller one of a pressure feedback control for controlling the pump flow rate based on a set pressure as a cutoff pressure and a pump pressure, and an ordinary control for controlling the pump flow rate based on operation information, and flow rate command value increasing means operative in a case that the pressure feedback control is selected by the selecting means, for increasing the flow rate command value with the passage of time, as compared to a flow rate command value under the pressure feedback control without the flow rate command value increasing means.

2. The hydraulic control apparatus of working machine according to claim 1, wherein the flow rate command value increasing means increases the flow rate command value with a positive slope by reducing a control gain with the passage of time.

3. The hydraulic control apparatus of working machine according to claim 1, wherein the flow rate command value increasing means increases the flow rate command value with a positive slope by increasing the set pressure with the passage of time.

4. The hydraulic control apparatus of a working machine according to claim 1, wherein the control means, after the pressure feedback control is selected, in the case that the flow rate command value of the ordinary control is subsequently selected as the smaller value, is adapted to reset the flow rate increasing control.

5. A hydraulic control apparatus of working machine, the circuit comprising:

a hydraulic pump;

a hydraulic actuator driven by the hydraulic pump as a driving source;

a control valve for controlling supply and discharge of oil with respect to the hydraulic actuator;

a relief valve for setting a maximum pressure of the hydraulic circuit; and a controller having:

selecting means for selecting, as a flow rate command value, a smaller one of a pressure feedback control for controlling the pump flow rate based on a set pressure as a cutoff pressure and a pump pressure, and an ordinary control for controlling the pump flow rate based on operation information, flow rate command value increasing means operative in a case that the pressure feedback control is selected by the selecting means, for increasing the flow rate command value with the passage of time, as compared to a flow rate command value under the pressure feedback control without the flow rate command value increasing means, and means for selecting an on or off state of the flow rate command value increasing means.

6. A hydraulic control apparatus of working machine, the circuit comprising:

a hydraulic pump;

a hydraulic actuator driven by the hydraulic pump as a driving source;

a control valve for controlling supply and discharge of oil with respect to the hydraulic actuator;

a relief valve for setting a maximum pressure of the hydraulic circuit; and a controller having:

selecting means for selecting, as a flow rate command value, a smaller one of a pressure feedback control for controlling the pump flow rate based on a set pressure as a cutoff pressure and a pump pressure, and an ordinary control for controlling the pump flow rate based on operation information, flow rate command value increasing means operative in a case that the pressure feedback control is selected by the selecting means, for increasing the flow rate command value with the passage of time, as compared to a flow rate command value under the pressure feedback control without the flow rate command value increasing means, and mode switching means for switching between a first energy-saving mode wherein said selecting means and said flow rate command value increasing means are operative, a second energy-saving mode wherein said selecting means is operative and said flow rate command value increasing means is not operative, and a high-power mode wherein said selecting means is not operative and said flow rate command value is set according to ordinary control based on operation information.

* * * * *